US006634719B1

(12) United States Patent
Monroe

(10) Patent No.: US 6,634,719 B1
(45) Date of Patent: Oct. 21, 2003

(54) ICE SCRUFFER

(75) Inventor: James C. Monroe, Auburn, ME (US)

(73) Assignee: SnoTech, Inc., Auburn, ME (US)

( * ) Notice: Subject to any disclaimer, the term of this patent is extended or adjusted under 35 U.S.C. 154(b) by 48 days.

(21) Appl. No.: 09/930,581

(22) Filed: Aug. 15, 2001

(51) Int. Cl.[7] ..... E21B 15/02
(52) U.S. Cl. ..... 299/24; 299/39.4
(58) Field of Search ..... 37/196, 232, 233, 37/242, 244, 248, 253, 251, 256; 172/107; 299/24, 39.4, 39.7

(56) References Cited

U.S. PATENT DOCUMENTS

| | | | | | |
|---|---|---|---|---|---|
| 2,606,011 | A | * | 8/1952 | Lommen | 299/25 |
| 2,732,573 | A | * | 1/1956 | Hyland | 15/82 |
| 3,724,182 | A | | 4/1973 | Long et al. | |
| 3,779,319 | A | * | 12/1973 | Pease | 172/45 |
| 3,916,607 | A | | 11/1975 | Howard | |
| 4,199,903 | A | | 4/1980 | Fitzpatrick | |
| 4,295,274 | A | | 10/1981 | Bricher et al. | |
| 4,344,273 | A | | 8/1982 | Jobling et al. | |
| 4,368,554 | A | | 1/1983 | Mealing et al. | |
| 4,446,681 | A | | 5/1984 | Dynie et al. | |
| 4,480,349 | A | | 11/1984 | Barr | |
| 4,592,108 | A | | 6/1986 | Svendsen | |
| 4,842,440 | A | | 6/1989 | Alguire | |
| 4,843,768 | A | | 7/1989 | Stanfield | |
| 4,903,780 | A | * | 2/1990 | Barbieri | 172/122 |
| 4,943,016 | A | * | 7/1990 | Hennecke | 248/59 |
| 5,040,315 | A | | 8/1991 | Matson | |
| 5,045,217 | A | * | 9/1991 | Ronan et al. | 210/776 |
| 5,106,165 | A | * | 4/1992 | Lattman | 299/25 |
| 5,515,625 | A | | 5/1996 | Keigley | |
| 5,540,004 | A | * | 7/1996 | Patterson et al. | 37/244 |
| 5,561,921 | A | | 10/1996 | Vanderlinden | |
| 5,797,203 | A | | 8/1998 | Vanderlinden | |
| 5,974,771 | A | | 11/1999 | Greenan | |
| 6,431,656 | B1 | * | 8/2002 | Kammerer | 299/79.1 |

* cited by examiner

*Primary Examiner*—David Bagnell
*Assistant Examiner*—Daniel P Stephenson
(74) *Attorney, Agent, or Firm*—Patricia M. Mathers; Thomas L. Bohan

(57) ABSTRACT

An ice scruffing device for scruffing a covering of ice on a ground surface to improve the ability of the ice to retain de-icing chemicals on its surface. Paddles are mounted radially about a drum that is mounted substantially parallel to the ground surface and transverse to the direction of travel of a prime mover of the ice scruffing device. Each paddle bears a plurality of impactors. The impactors are made of flexible wire cable, with a strike element arranged at the end of the cable. As the drum rotates, the strike elements strike the ice on the ground surface at high velocity, thereby creating random, discrete indentations, cracks, pit-marks in the surface.

18 Claims, 3 Drawing Sheets

ICE SCRUFFER

FIELD OF THE INVENTION

The invention relates to the field of ground-surface de-icing. More particularly, the invention relates to a device for treating icy ground surfaces. More particularly yet, the invention relates to a device that creates discrete depressions on an ice-covered ground surface.

DESCRIPTION OF THE PRIOR ART

Keeping ground surfaces, particularly roads and airport runways, free of ice has long been a major problem in geographical regions where temperatures drop below freezing. Over the years, many methods and apparatus have been developed and constructed to clear such ground surfaces of ice. The methods includes scarifying the ice, that is, cutting grooves into the ice to increase the surface area that is exposed to warming rays of the sun. The disadvantage of using an ice scarifier, and indeed, any apparatus using a ground-surface scraping device such as a blade or a rake, is that the downward force that can be applied to the ground surface is limited by the reaction force that can be applied to the vehicle without impairing the ability of the vehicle to travel across the surface.

U.S. Pat. No. 4,842,440 (Alguire; issued 1989) discloses a road grader and scarifier, that is adaptable to serve as an ice-scarifier. According to the Alguire publication, a scraper blade is attached to the bottom of a dump body on a dump truck. During scraping operations, the weight of the dump body rests upon the blade and provides the downward force that is applied by the blade to the ground surface. A disadvantage of this apparatus is that significant downward force must be applied to the ground surface in order to scratch the grooves into it and, thus, it suffers the same disadvantages of scarifiers. A dump truck that is carrying a fully-loaded dump body may provide sufficient downward force for grading a gravel road, but may not provide the force needed to scarify an ice-covered road surface without reducing the traction needed for the vehicle to move forward, or may be able to travel only at a very slow speed.

Numerous other devices and apparatus with rake attachments or cutter blades are known for scarifying or raking ground surfaces. All of these have at least the disadvantage described above with respect to the Alguire road grader, and are generally much lighter in weight and even less suitable for scraping a hard, ice-covered ground surface because of the small amount of downward force that they can apply to the ground surface. It is also known to mount a scraper blade with a serrated edge under the frame of a plow truck, between the front and rear axles, for scraping grooves into an ice-covered ground surface. Again, the plow truck has the same disadvantage as the Alguire road grader.

A particular difficulty in clearing airport runways of ice is that the runway has a specific surface contour that may include grooves. It is important that the runway surface contour not be damaged, and therefore, ice is generally removed chemically. Chemical methods of de-icing ground surfaces include spraying a de-icing fluid or scattering de-icing crystals or solids over the ice-covered surface. One common disadvantage of these two methods is that, as the ice melts, the water flows toward low-lying areas, entraining the de-icing chemicals with it. This effectively removes the deicing chemicals from high-lying areas. For this reason, on critical roadways and runways that require de-icing quickly or have particular surface contours, the ice-covered surface is often first scarified and the de-icing chemicals subsequently applied to the scarified surface in liquid or solid form.

The scarified surface typically comprises a series of contiguous grooves that serve as retaining grooves for the de-icing treatment material. The contiguous grooves, however, are ineffective in retaining the de-icing chemicals because, as the ice begins to melt, the water flows and collects in puddles in low-lying regions of the surface. The result is that on a grooved surface with only a very slight slope or unevenness, the de-icing chemicals will be entrained in the water and flow from the higher-lying regions into the low-lying regions. This effectively removes the de-icing chemicals from higher-lying regions before they have completely melted the ice, thereby leaving potentially large patches of the ground surface scarified, but covered with ice—an unacceptable situation for roads and runway surfaces.

What is needed, therefore, is an apparatus that can provide sufficient downward force to make depressions in an ice-covered ground surface without reducing the ability of the prime mover to travel across the surface. What is further needed is a device that will make discrete, random depressions in the ice-covered ground surface such that the surface will serve to retain de-icing chemicals on the surface evenly distributed about the ice-covered ground surface. What is yet further needed is such a device that will not damage the surface contour of the ground surface. And what is still yet further needed is such a device that can be operated at an acceptable speed.

BRIEF SUMMARY OF THE INVENTION

It is an object of the present invention to provide a ground surface treatment apparatus that will create random, discrete depressions on the top surface of an ice-covered ground surface. It is a further object to provide such an apparatus that will provide sufficient downward force to impinge on the ice-covered ground surface without losing its ability to travel across the ground surface at an acceptable speed. It is a yet further object to provide such an apparatus that will follow the contour of the ground surface and not damage the contour.

The objects are achieved by providing an ice-scruffing device that creates a scruffed or textured surface on an ice-covered ground surface. The term "scruffed" shall be used herein to refer to a surface having random depressions or indentations, such as pock-marks, pitting, and/or cracks, as opposed to grooves, slits and/or punctures. The term "scruffed" also includes shattering of the surface, such as when hard, blue ice surface is impacted with a small hard object. Analogously, the device of the present invention is referred to as an "ice scruffer" and is a device that creates a scruffed surface on an ice-covered surface such as an iced roadway or runway, or a roadway packed with hard snow or covered with heavy slush.

The ice scruffer of the present invention is a drum fitted with a plurality of paddles, each paddle fitted with a series of strike elements, also called "abraders" or "scruffing elements." The drum is mounted in a frame and extends transverse to the travel direction of the frame, which is pulled or pushed along the ground surface by a prime mover. The drum and the frame are similar to the drum and frame disclosed by the inventor of the present invention in U.S. Pat. No. 6,260,293 (issued 2001), which is herein incorporated by reference. The paddles of the ground-cleaning apparatus of the just-mentioned patent are replaced by the paddles of the ice scruffer according to the present invention to provide a device that does not clean, i.e., pick up material or debris from the ground surface, but rather, scruffs the upper surface of the ice-covered or snow-packed ground surface to create a surface that has randomly placed, discrete depressions. Furthermore, since the apparatus of the present invention does clean the ground surface, it also does not require the impeller/discharge assembly of the ground-cleaning apparatus.

The ice scruffer paddle includes a series of stiffly flexible cables that are fastened to the paddle at one end, each cable ending in a small, hard strike element also referred to as an impactor. As the drum rotates, the paddles rotate radially about the rotational axis of the drum, thereby swinging the strike elements attached to the ends of the cables with a greater velocity than that of the core of the drum. The ice scruffer is adjustable in height, and ideally, the apparatus is adjusted so that the impactors strike the ground surface and penetrate the surface to a depth that provides an indentation of the desired depth. The ice scruffer is pivotably mounted in a frame so that it can pivot or swing slightly about a roll axis and/or a pitch axis and, therefore, can follow closely the contour of the road or runway without damaging the contour.

DETAILED DESCRIPTION OF THE INVENTION

Figure 1:
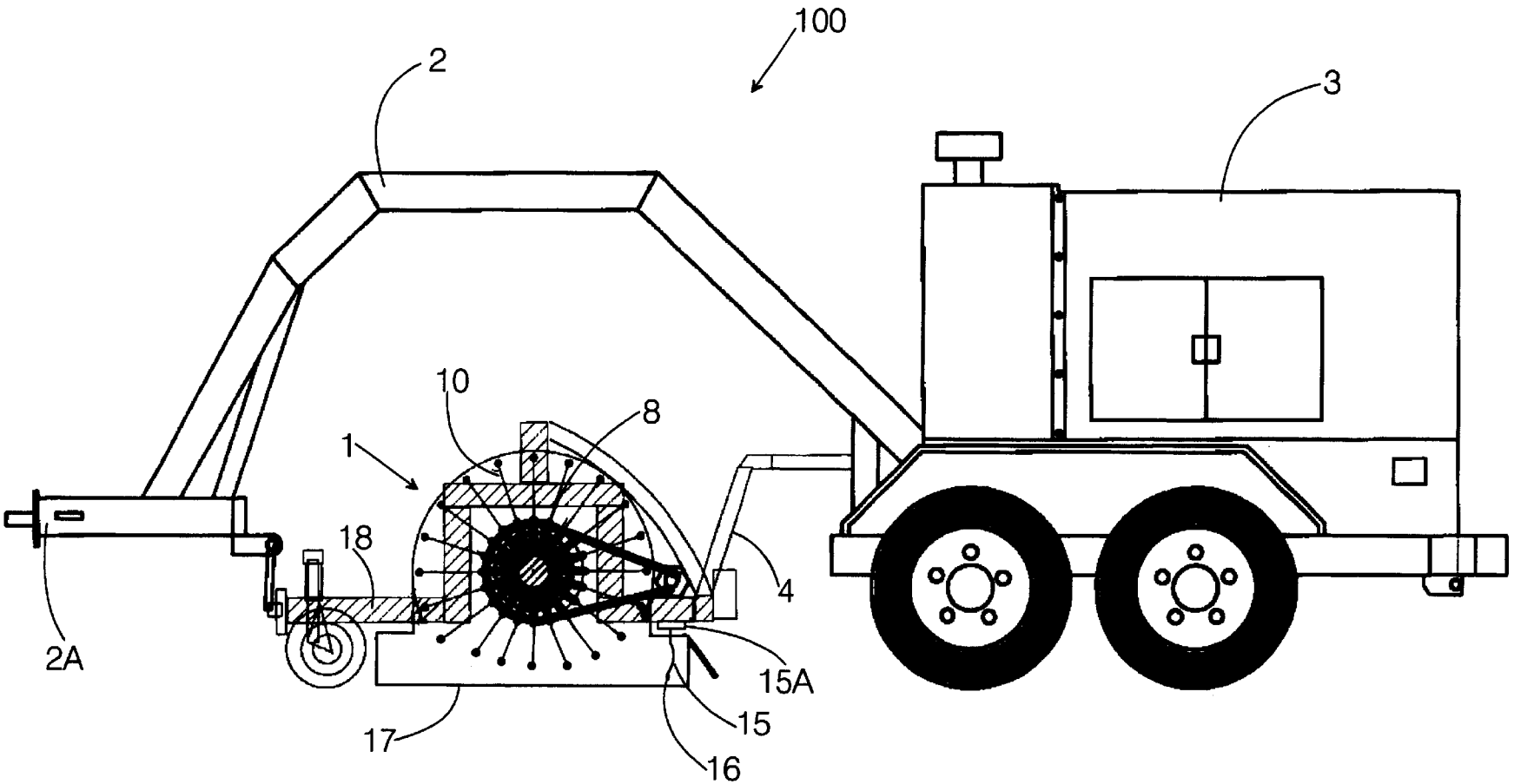
FIG. 1 is a side view of the ice scruffing apparatus according to the present invention, connected to a power deck.

FIG. 1 shows a side view of a schematic illustration of the Preferred Embodiment of an ice scruffing apparatus 100. The apparatus 100 comprises an ice-scruffing device 1, a fixed frame 2, and a power deck 3. As can be seen in FIG. 1, the ice-scruffing device 1 is supported by a rigid drum frame 18 that is attached to a pivotable frame 4. The pivotable frame 4 is height-adjustable so that the distance from the ice-scruffing device 1 to the ground surface can be adjusted. The frame 4 also allows the scruffing device 1 to pivot or swing about two axes to provide a rolling and/or pitching motion of the scruffing device 1, thereby enabling the device 1 to closely follow the contour of the ground surface. The pivotable frame 4 is attached to the fixed frame 2.

In the Preferred Embodiment, the apparatus 100 is completely enclosed in a housing 17, the outline of which is illustrated in FIG. 1 with dashed lines. During operation, the apparatus 100 is pulled by a prime mover, such as a truck (not shown) and a front end 2A of the fixed frame 2 has a means for hitching the apparatus 100 to the prime mover. As mentioned above, U.S. Pat. No. 6,260,293 (issued 2001) discloses an apparatus for clearing ground surfaces of snow and debris. The fixed frame 2, pivotable frame 4, and the power deck 3 of the present invention are similar to those disclosed in that patent, and a more detailed description of those components is included therein.

Figure 2:
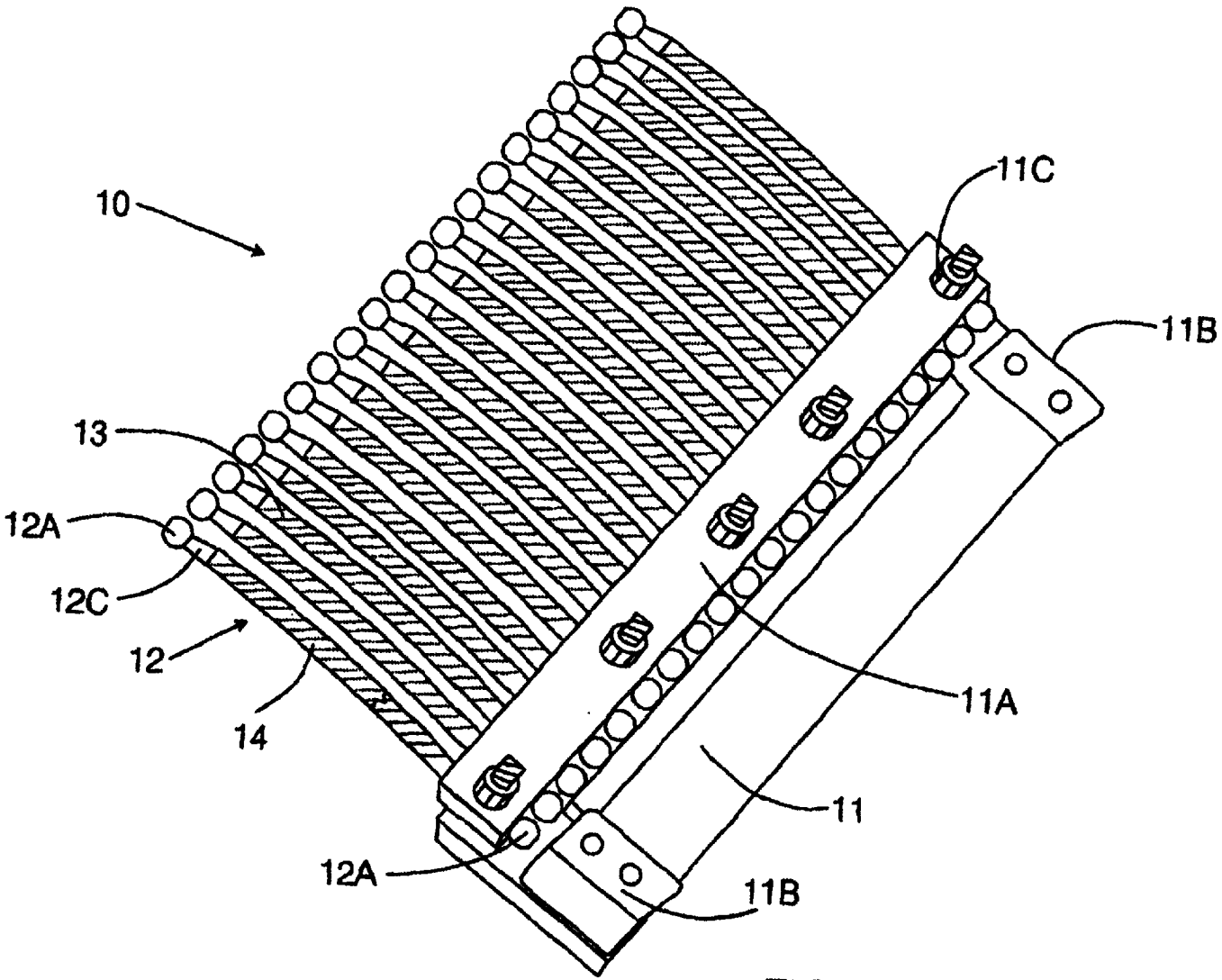
FIG. 2 is a perspective view of the ice scruffing paddle of the Preferred Embodiment.
Figure 3:
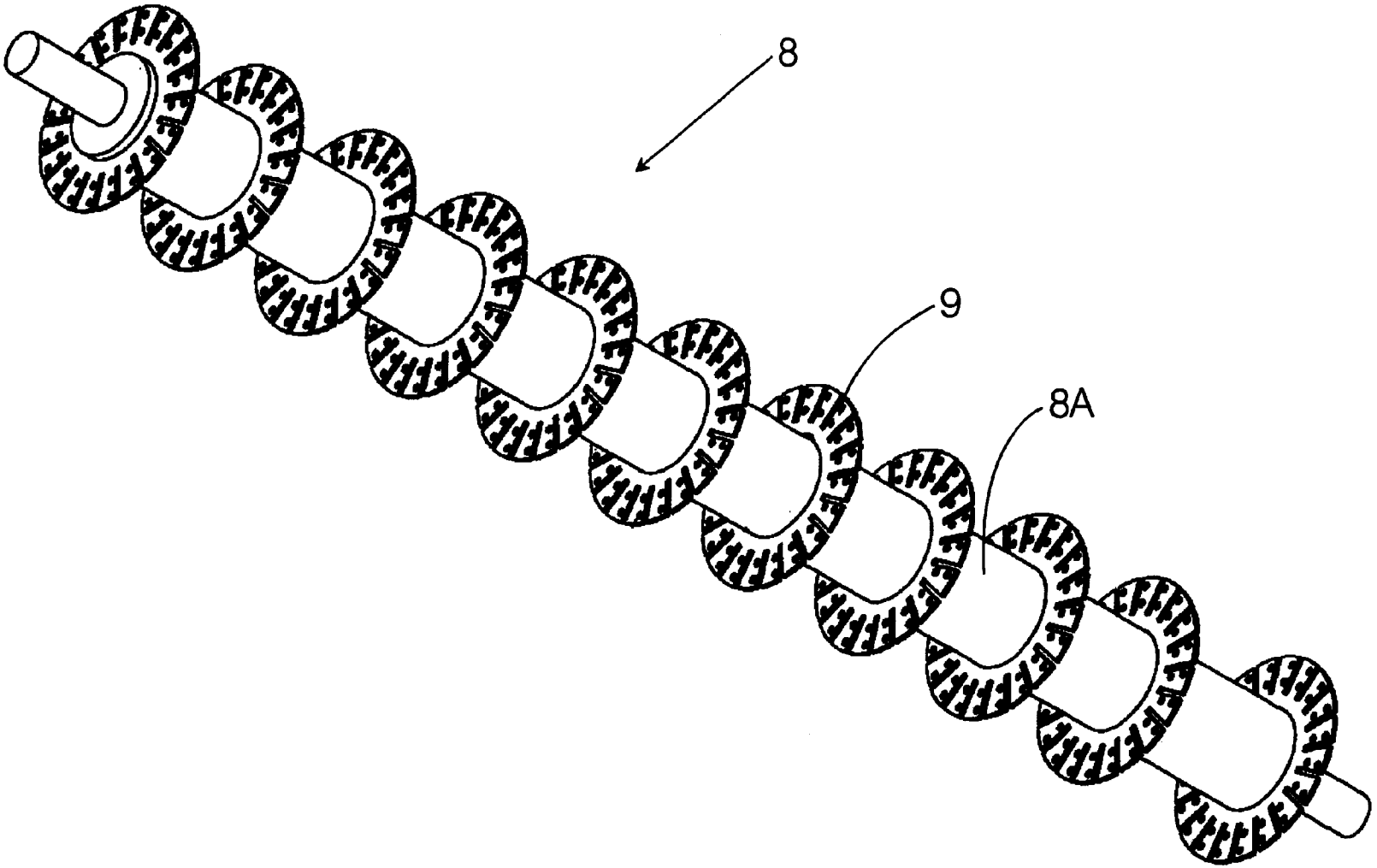
FIG. 3 is a perspective view of the drum of the Preferred Embodiment.

The heart of the present invention lies in the ice-scruffing device 1, which comprises a drum 8 and a plurality of ice-scruffing paddles 10. FIG. 2 shows a perspective view of one paddle 10 and FIG. 3 is a schematic illustration of a drum 8 without the paddles 10 attached. The paddles 10 are mounted on the drum 8 similar to the mounting of the paddles shown in FIGS. 5 and 7 of the above-cited U.S. Pat. No. 6,260,293. A plurality of strike elements 12 are fastened to a paddle bracket 11 by a strike element-fastening means, which, in the Preferred Embodiment, is a fastener bar 11A that is fastened to the paddle bracket 11 by a plurality of fasteners 11C. Each strike element 12 comprises a twisted cable 13 of fine strands of wire and a striker 12A that is attached to each end of the cable 13. In the Preferred Embodiment, the strike element 12 is removably fastened in the paddle bracket 11 and the striker 12A is a ball with a shank 12C that is fastened to the end of the cable 13 by swaging, crimping or other suitable means that will provide a connection that is equal to or exceeds the breaking strength of the cable 13. In the Preferred Embodiment, the shank 12C is swaged to the cable 13 by applying a uniform compressive force around the shank 12C that is fitted over the end of the cable 13.

The strikers 12A at the two ends of the cable 13 are constructed similarly, so that each end can be used as the operative impacting instrument against the ice. That is, when the striker 12A is damaged or worn at one end, the paddle bracket 11 can be opened up and the strike element 12 inserted in the base 11 such that the damaged striker is held in the paddle bracket 11 and the striker previously held in the bracket 11 is now used as the strike instrument when the ice-scruffing apparatus 100 is in operation.

In the Preferred Embodiment, the drum 8 is divided into sections 8A along its longitudinal axis. The sections 8A are adapted in width to receive a paddle bracket 11. A plurality of paddles 10 is arranged radially around each section 8A. The paddles 10 are preferably arranged in each section 8A such that they are offset in position about the drum 8 relative to adjacent paddles 10 along a longitudinal axis of the drum 8. In the Preferred Embodiment, a series of paddle mounting discs 9 is fixedly mounted on the drum 8 as shown in FIG. 3 to serve as a mount for the paddles 10. Each paddle 10 is fastened to the drum 8 by a fastening means 11B that is preferably removably fastened to the respective paddle mounting disc 9. In this way, individual paddles 10 can be removed from the drum 8 and replaced with new ones.

It is also possible to fit the drum with a combination of different types of paddles. For example, a rubber paddle or other type of paddle that is suitable for sweeping the icy surface free of ice chips may be alternately mounted on the drum 8.

In the Preferred Embodiment, the cable 13 is a nylon-jacketed, galvanized carbon steel 7×19 flexible wire rope aircraft-type cable. Carbon steel provides greater tensile strength than stainless steel and galvanizing provides corrosion resistance. For additional protection against the highly corrosive chemicals typically used in de-icing applications, the cable 13 is enclosed in a nylon sheath that remains flexible and serviceable to a temperature of minus 65° F.

Referring again to FIG. 1, a blade 15 is swingably mounted beneath the scruffing device 1. The blade 15 is a strip of material that is swingably mounted on the underside of the pivotable frame 4 behind the drum 8 and that extends from one side of the scruffing device 1 to the other. The blade 15 is concave in shape, the center point of the circle that defines the curve being forward of the blade 15 toward the front end 2A of the fixed frame 2. The major portion of the blade 15 is made of a stiff material; a blade edge 16 of a softer, more flexible material extends along the lower edge of the blade. The blade 15 is attached to a blade mount 15A that is constructed such that the blade 15 can swing approximately 15° relative to the axis of the drum 8 and be secured in that position. As the scruffing device 1 moves across the ice-covered ground surface, the blade 15, when positioned at an angle relative to the drum axis, pushes chips, flakes, and other pieces of the ice to one side or the other of the roadway or runway. The blade 15 can be secured in a neutral position that extends parallel to the drum 8. In the Preferred Embodiment, the blade 15 is slightly raised in the neutral position, so that the blade 15 passes over the chips that then remain on the ground surface, primarily within the confines of the surface area that is impacted by the scruffing device 1.

While a Preferred Embodiment is disclosed herein, this is not intended to be limiting. Rather, the general principles set forth herein are considered to be merely illustrative of the scope of the present invention and it is to be further understood that numerous changes may be made without straying from the scope of the present invention.

What is claimed is:

1. A device for striking a covering of ice on a ground surface, said device comprising a drum having a rotational axis and a paddle, wherein said paddle has a paddle bracket and a plurality of strike elements, said paddle bracket being rigidly mounted on said drum such that said strike elements radially from said drum, and wherein each individual one of said elements includes a of stiffly flexible cable with a striker attached to each end of said cable, and wherein said strike elements rotate about said rotational axis with said drum and strike said covering of ice so as form discrete surface depressions in said covering.

2. The device of claim 1, wherein said cable is a carbon steel cable.

3. The device of claim 2, wherein said carbon steel cable is sheathed in a protective coating.

4. The device of claim 3, wherein said protective coating is a nylon sheath.

5. The device of claim 1 further comprising a scraper blade assembly that is mounted behind said drum and that is pivotable from a neutral position to a discharge position that is angled relative to the longitudinal axis of said drum.

6. The device of claim 5, wherein said scraper blade assembly includes a primary blade that is of stiff material and slightly concave and a scraper edge that extends along a lower edge of said primary blade and is of a material that is flexible and softer than said stiff material of said primary blade.

7. The device of claim 6, wherein said neutral position of said blade extends parallel to a longitudinal axis of said drum.

8. The device of claim 6, wherein said discharge position includes an angle relative to said longitudinal axis of said drum that is greater than 0° and less than 20°.

9. A paddle used in an ice-scruffing device, said paddle comprising a paddle bracket and a plurality of ice-scruffing elements held in and extending from said paddle bracket, and wherein each of said ice-scruffing elements includes a stiffly flexible cable having a first end and a second end, with a first striker attached to said first end and a second striker attached to said second end.

10. An ice scruffing apparatus for scruffing a surface of ice covering a ground surface, said apparatus comprising:

a power deck;

a fixed frame;

a pivotable frame;

a rotatable ice scruffing drum having a rotational axis and a plurality of scruffer paddles;

wherein said fixed frame is adjustable in height and attached to said power deck and said pivotable frame is suspended from said fixed frame, wherein said ice-scruffing drum is mounted in said pivotable frame and said rotational axis of said drum extends transverse to a travel direction of said apparatus; and wherein said scruffer paddles include a paddle bracket that is mounted in said drum, a plurality of scruffer elements, each one of said scruffer elements comprising a stiffly flexible cable with a striker attached to each end of said cable, and wherein said scruffer elements are securely fastened within said paddle bracket such that a first striker attached to a first end of said cable extends radially from said ice-scruffing drum and, when said drum rotates, said first striker strikes said ice-covered ground surface with sufficient force to create a depression in said surface of ice.

11. An ice-scruffing element for use with a rotatable drum, wherein said ice scruffing element, when said drum rotates, strikes a ground surface and wherein, when said ground surface is an ice-covered ground surface, strikes with sufficient force to create a depression in said ice-covered around surface, said ice-scruffing element comprising:

strikers that include a first striker, a second striker, and a connecting cable having a first end and a second end, wherein said first striker is attached to said first end and said second striker to said second end.

12. The ice-scruffing element of claim 11, wherein said strikers are spherical elements.

13. The ice-scruffing element of claim 11, wherein said connecting cable is a stiffly flexible cable.

14. The ice-scruffing element of claim 11, wherein said connecting cable is sheathed in a protective sheath.

15. Ice-scruffing apparatus comprising:

a rotatable drum adapted to receive said first end or said second end of said ice-scruffing element of claim 11.

16. Apparatus for scruffing a covering of ice on a ground surface, said apparatus comprising:

a drum having a drum length;

a series of paddle-mounting brackets;

a plurality of paddles; and ice-scruffing elements, each individual ice-scruffing element comprising a cable with an attachment end and an operating end, with a striker element attached to said operating end;

wherein said paddle-mounting brackets are arranged on said drum to provide drum sections and said paddles are arranged on said paddle-mounting brackets in an off-set pattern so that a first paddle in a first drum section is radially offset to any paddle in an adjacent drum section;

wherein each individual paddle of said plurality of paddles holds a plurality of said ice-scruffing elements; and wherein, when said drum rotates, said operating end of said ice-scruffing elements strikes an ice-covered ground surface so as to form discrete surface depressions in said ice-covered ground surface.

17. The device of claim 16, wherein said plurality of paddles includes one or more first-type paddles and one or more second-type paddles, wherein said first-type paddles are fitted with said ice-scruffing elements and said second-type paddles are fitted with a sweeper blade suitable for sweeping said ground surface.

18. The device of claim 16, wherein said second-type paddies include rubber paddles.

* * * * *

UNITED STATES PATENT AND TRADEMARK OFFICE

CERTIFICATE OF CORRECTION

PATENT NO. : 6,634,719 B1
DATED : October 21, 2003
INVENTOR(S) : James C. Monroe It is certified that error appears in the above-identified patent and that said Letters Patent is hereby corrected as shown below:

Column 5,
Line 10, -- extend -- should follow "elements"
Line 11, "and" should be deleted Signed and Sealed this Second Day of March, 2004

JON W. DUDAS
*Acting Director of the United States Patent and Trademark Office*